US009025973B2

(12) United States Patent
Suzuki et al.

(10) Patent No.: US 9,025,973 B2
(45) Date of Patent: May 5, 2015

(54) IMAGE FORMING APPARATUS

(71) Applicant: Canon Kabushiki Kaisha, Tokyo (JP)

(72) Inventors: Takafumi Suzuki, Suntou-gun (JP); Masaya Tsukamoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/159,733

(22) Filed: Jan. 21, 2014

(65) Prior Publication Data

US 2014/0212152 A1 Jul. 31, 2014

(30) Foreign Application Priority Data

Jan. 31, 2013 (JP) ..... 2013-017482
Jan. 15, 2014 (JP) ..... 2014-005430

(51) Int. Cl.
*G03G 15/20* (2006.01)
*G03G 21/16* (2006.01)

(52) U.S. Cl.
CPC ..... *G03G 21/1633* (2013.01)

(58) Field of Classification Search
CPC ..... G03G 15/00; G03G 15/20; G03G 21/00; G03G 21/16
USPC ..... 399/21, 122
See application file for complete search history.

(56) References Cited

U.S. PATENT DOCUMENTS 5,348,283 A 9/1994 Yanagi et al.
5,370,380 A 12/1994 Suzuki et al.
5,508,796 A 4/1996 Sasame et al.
5,539,507 A 7/1996 Miyashiro et al.
5,543,904 A 8/1996 Kato et al.
5,580,042 A 12/1996 Taniguro et al.
5,592,280 A 1/1997 Ishizuka et al.
5,620,174 A 4/1997 Taniguro et al.
5,648,808 A 7/1997 Yanagi et al.
5,672,019 A 9/1997 Hiramatsu et al.
5,725,319 A 3/1998 Saito et al.
5,761,571 A 6/1998 Suzuki et al.
5,999,760 A 12/1999 Suzuki et al.
6,016,418 A 1/2000 Kabeya et al.
6,088,567 A 7/2000 Miyashiro et al.
6,151,476 A 11/2000 Tsuruya et al.
6,151,477 A 11/2000 Takeuchi et al.
6,168,270 B1 1/2001 Saikawa et al.
6,341,905 B1 1/2002 Suzuki
6,731,903 B2 5/2004 Suzuki
6,792,241 B2 9/2004 Nakagawa et al.

(Continued)

FOREIGN PATENT DOCUMENTS

JP 61-193159 A 8/1986
JP 02248964 A * 10/1990 ..... G03G 15/00

(Continued)

*Primary Examiner* — Nguyen Ha
(74) *Attorney, Agent, or Firm* — Fitzpatrick, Cella, Harper & Scinto

(57) ABSTRACT

An image forming apparatus includes a main body movably supporting an openable-and-closable portion, and the openable-and-closable portion is provided with a detection sensor. A first detection lever configured to be movable by being pushed by a sheet is provided on the main body, and a second detection lever configured to be capable of moving in conjunction with the movement of the first detection lever is provided on the openable-and-closable portion. The detection sensor is activated by the movement of the second detection lever based on the movement of the first detection lever.

18 Claims, 15 Drawing Sheets

(56) References Cited

U.S. PATENT DOCUMENTS

| | | | |
|---|---|---|---|
| 6,845,228 | B2 | 1/2005 | Suzuki et al. |
| 6,908,078 | B2 | 6/2005 | Suzuki et al. |
| 6,950,616 | B2 | 9/2005 | Saito et al. |
| 7,080,830 | B2 | 7/2006 | Suzuki et al. |
| 7,354,034 | B2 | 4/2008 | Nakamura et al. |
| 7,543,806 | B2 | 6/2009 | Nakamura et al. |
| 7,684,726 | B2 | 3/2010 | Suzuki et al. |
| 8,042,804 | B2 | 10/2011 | Suzuki |
| 2007/0104497 | A1 * | 5/2007 | Kwon ..... 399/16 |
| 2007/0253756 | A1 * | 11/2007 | Uehara ..... 399/322 |
| 2010/0221050 | A1 * | 9/2010 | Kobayashi et al. ..... 399/389 |
| 2011/0049792 | A1 | 3/2011 | Suzuki |

FOREIGN PATENT DOCUMENTS

| | | | | |
|---|---|---|---|---|
| JP | 11-125983 | A | 5/1999 | |
| JP | 2005060058 | A * | 3/2005 | ..... G03G 21/16 |
| JP | 2007298740 | A * | 11/2007 | ..... G03G 15/20 |

* cited by examiner

IMAGE FORMING APPARATUS

BACKGROUND OF THE INVENTION

1. Field of the Invention

This disclosure relates to an image forming apparatus configured to form an image on a sheet.

2. Description of the Related Art

In the related art, an image forming apparatus including a sensor provided at a position downstream of a fixing unit in a direction of sheet conveyance and configured to detect a paper jam in the fixing unit or a delay of a sheet conveyed to the fixing unit is known. The fixing unit is configured to heat and fix toner images to sheets. For example, JP-A-11-125983 discloses an image forming apparatus including an optical sensor as the sensor described above, and a detection lever having a sheet detecting portion mounted on a pivotal shaft of the detection lever and a sensor activating portion mounted on the pivotal shaft of the detection lever. The detection lever is configured to be rotated (pivoted) about the pivotal shaft by a contact of the sheet detecting portion with a sheet and block and allow entry of light to a light-receiving portion of the optical sensor by the sensor activating portion in accordance with a rotating action of the detection lever.

However, the optical sensor may cause an erroneous operation due to moisture vapor generated from a sheet at the time of heat fixation, a failure due to radiant heat generated at the time of heat fixation, or the like. In recent years, the amount of moisture vapor generated from the sheet at the time of heat fixation per unit time is now increasing in association with an increase in printing speed. Therefore, there is a demand for an arrangement of the optical sensor at a position less susceptible to the moisture vapor generated from the sheet at the time of heat fixation and to the radiation heat at the time of heat fixation.

Here, in an apparatus having an openable-and-closable door arranged in the vicinity of a fixing unit, a configuration in which an optical sensor is arranged in a door (see JP-A-61-193159) to prevent an increase in size of an entire image forming apparatus while arranging the optical sensor at a position far from the fixing unit is conceivable. In order to arrange the optical sensor at a position far from a heat source of the fixing unit, the length of an arm of the sheet detecting portion and the length of an arm of the activating portion need to be long. However, if the arm of the detection lever is long in a case where the optical sensor is arranged in the door, a large amount of the arm sticks out when the door is opened. If a large amount of the arm of the detection lever sticks out when the door is opened, the user may touch the arm with no discretion. Therefore, the likelihood of breaking the detection lever is increased.

SUMMARY OF THE INVENTION

According to a first aspect of the present invention, an image forming apparatus includes a main body including a toner image forming portion configured to form a toner image, a fixing portion configured to heat and fix the toner image formed by the toner image forming portion to a sheet, a first detection lever configured to be moved by being pushed by the sheet on which the toner image is fixed, and a first supporting member configured to movably support the first detection lever, and an cover portion movably supported by the main body and including a second detection lever configured to move in conjunction with the movement of the first detection lever, a second supporting member configured to support the second detection lever, and a detection sensor configured to be activated in accordance with the movement of the second detection lever, the cover portion being configured at a closed position with respect to the main body to cause the second supporting member to come into contact with the first supporting member, and the second supporting member to be positioned so as to allow the second detection lever to move in conjunction with the movement of the first detection lever.

According to a second aspect of the present invention, an image forming apparatus includes a main body, a first detection lever provided on the main body and configured to be moved by being pushed by a sheet, an openable-and-closable portion movably supported by the main body, a second detection lever provided on the openable-and-closable portion and configured to be movable in conjunction with the movement of the first detection lever, and a detection sensor provided on the openable-and-closable portion and configured to be activated in accordance with the movement of the second detection lever.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Referring now to FIG. 1 to FIG. 15, an image forming apparatus according to embodiments of this disclosure will be described. In the embodiments, an electrophotographic laser beam printer (hereinafter, referred to as "printer") will be described as an example of the image forming apparatus. However, examples of the image forming apparatus that this disclosure may be applied include copying machines, printers, facsimiles, and composite apparatuses thereof.

First Embodiment

Figure 1:
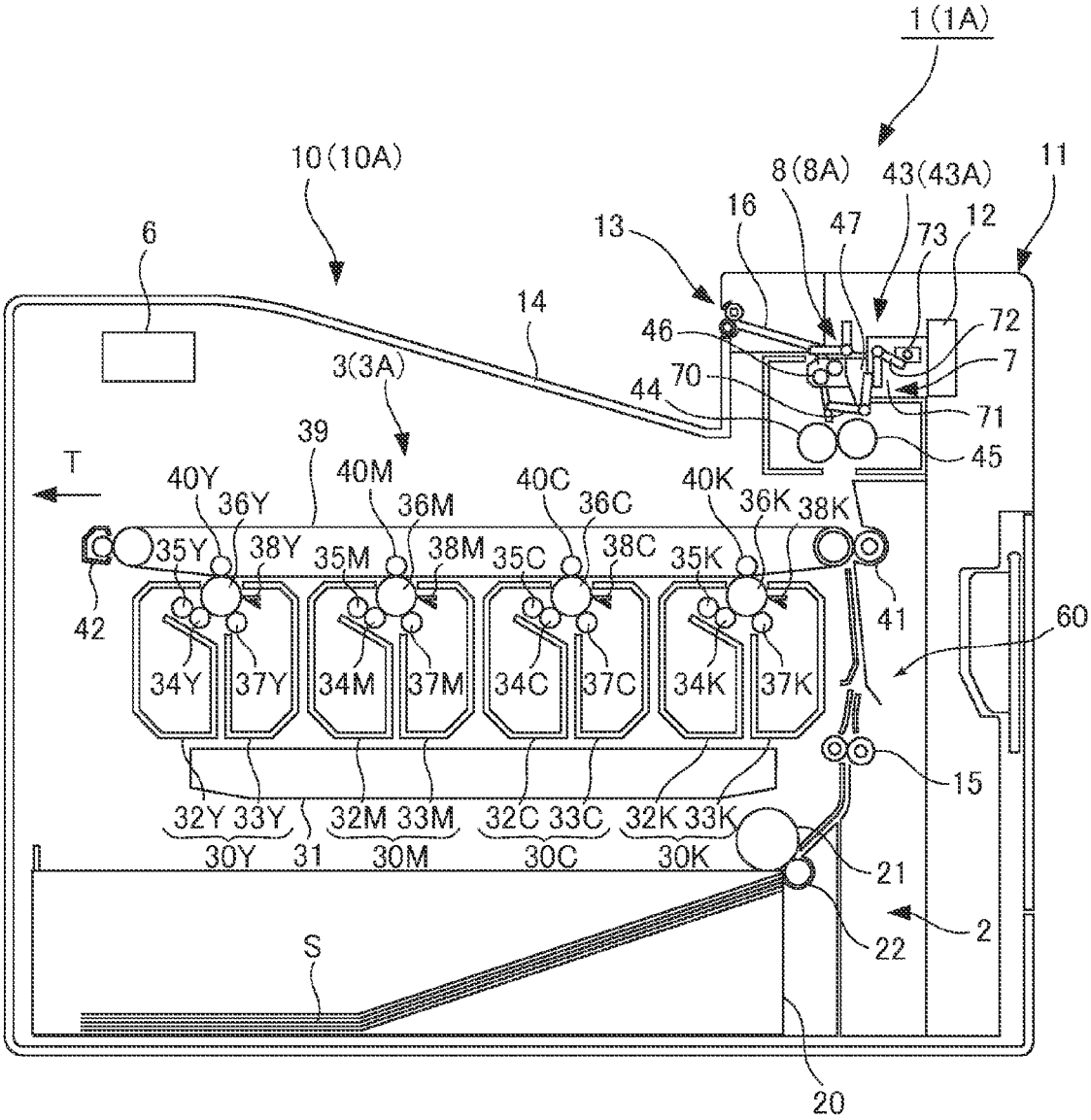
FIG. 1 is a cross-sectional view schematically illustrating a general structure of a printer according to a first embodiment of this disclosure.
Figure 2:
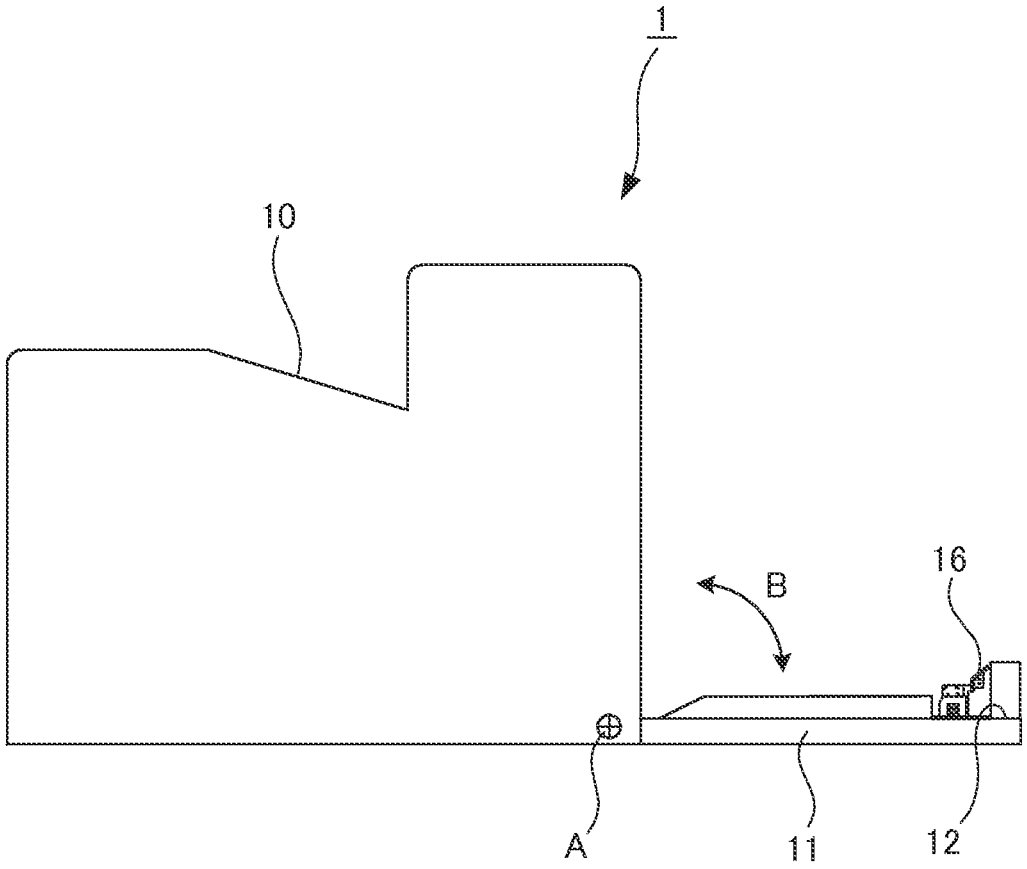
FIG. 2 is a side view schematically illustrating a state in which an openable-and-closable cover of the printer of the first embodiment is opened.

Referring now to FIG. 1 to FIG. 11, a printer 1 according to a first embodiment of this disclosure will be described. First of all, a general configuration of the printer 1 of the first embodiment will be described with reference to FIG. 1 and FIG. 2. FIG. 1 is a cross-sectional view schematically illustrating the general structure of the printer 1 according to the first embodiment of this disclosure. FIG. 2 is a side view schematically illustrating a state in which an openable-and-closable cover 11 of the printer 1 of the first embodiment is opened.

As illustrated in FIG. 1, the printer 1 includes a main body 10 of the printer 1 (hereinafter, referred to simply as "main body 10"), which functions as a main body of an image forming apparatus, and the openable-and-closable cover 11 as a cover portion rotatably supported by the main body 10. As illustrated in FIG. 2, the openable-and-closable cover 11 is supported by the main body 10 so as to be rotatable in a direction indicated by an arrow B about an axis of rotation A so that a sheet conveyance path 60 provided in the interior of the main body 10 (in the interior of the main body of the image forming apparatus) is openable. In the first embodiment, the sheet conveyance path 60 from a registration roller pair 15, which will be described later, toward a secondary transfer roller 41 is configured to be opened by opening the openable-and-closable cover 11. The openable-and-closable cover 11 includes an inner cover 12 on a side where the sheet conveyance path resides. The inner cover 12 lies in the vicinity of a fixing unit (fixing portion) 43, which will be described later, when the openable-and-closable cover 11 is closed.

The main body 10 includes a sheet feeding unit 2 configured to feed sheets, an image forming unit 3 configured to form an image on each sheet S, a discharge roller pair 13 configured to discharge the sheets S on which the image is formed, a discharge tray 14 configured to stack the discharged sheets S, and a control unit 6.

The sheet feeding unit 2 includes a feed cassette 20 configured to store the sheets S, a feed roller 21 configured to feed the sheets S stored in the feed cassette 20, and a separation roller 22 configured to separate the sheets S fed by the feed roller 21 into pieces.

The image forming unit 3 includes four process cartridges 30Y, 30M, 30C, and 30K configured to form images in four colors; yellow (Y), magenta (M), cyan (C), and black (K), and an exposure apparatus 31 configured to expose surfaces of photosensitive drums 36Y to 36K, which will be described later. The four process cartridges 30Y to 30K have the same configurations except that the colors of images to be formed thereon are different. Therefore, a configuration of the process cartridge 30Y which forms yellow (Y) images will be described as a representative, and descriptions on the process cartridges 30M to 30K will be omitted.

The process cartridge 30Y includes a developing unit 32Y and a cleaner unit 33Y. The developing unit 32Y includes a developing roller 34Y, a toner application roller 35Y, and a toner container, which is not illustrated. The cleaner unit 33Y includes a photosensitive drum 36Y which functions as an image bearing member, a charging roller 37Y, a drum cleaning blade 38Y, and a waste toner container, which is not illustrated.

The image forming unit 3 includes an intermediate transfer belt 39 to which toner images on the photosensitive drums 36Y to 36K are primarily transferred, and primary transfer rollers 40Y, 40M, 40C, and 40K configured to primarily transfer the toner images on the photosensitive drums 36Y to 36K to the intermediate transfer belt 39. In addition, the image forming unit 3 includes a secondary transfer roller 41 configured to secondarily transfer the toner images transferred by the primary transfer to the sheet S, a cleaning unit 42 configured to collect toner remaining on the intermediate transfer belt 39, and a fixing unit 43 configured to fix the toner images transferred by the second transfer with heat. The process cartridges 30Y to 30K, the exposure apparatus 31, the intermediate transfer belt 39, the primary transfer rollers 40Y to 40K, and the secondary transfer roller 41 of the first embodiment constitute a toner image forming portion.

The fixing unit 43 includes a fixing roller 44 and a press roller 45, which function as a fixing unit, a sheet detecting unit 7 disposed at a position downstream of the fixing roller 44 and the press roller 45, a decurling roller pair 46 disposed downstream of a first detection lever 70, which will be described later. The fixing unit 43 is provided with a jamming detecting unit (detecting unit) 8 disposed at a position downstream of the decurling roller pair 46 in a direction of sheet conveyance.

The fixing roller 44 includes a heater, which functions as a heat source, integrated therein, and the press roller 45 is in press contact with the fixing roller 44. The fixing roller 44 and the press roller 45 heat and press the toner images transferred to the sheet S with a nip therebetween to fix the toner images to the sheet. The sheet detecting unit 7 detects the sheet S discharged from the nip between the fixing roller 44 and the press roller 45. The sheet detecting unit 7 will be described later in detail. The decurling roller pair 46 is rotatably supported by a conveyance guide 47, which functions as a first supporting member, disposed downstream of the fixing roller 44 and the press roller 45, and configured to decurl a bending (hereinafter, referred to as "curl") of the sheets S discharged from the nip between the fixing roller 44 and the press roller 45. The jamming detecting unit 8 detects jamming of the sheet S that has failed to enter the decurling roller pair 46. The jamming detecting unit 8 will be described later in detail.

Subsequently, a print job (image forming job) controlled by the control unit 6 of the printer 1 configured as described above will be described.

When image information is input from an image reading apparatus, an external PC, or the like, which is not illustrated, the exposure apparatus 31 irradiates the photosensitive drums 36Y to 36K with a laser beam on the basis of the input image information. At this time, the photosensitive drums 36Y to 36K are charged at a negative potential in advance by the charging rollers 37Y to 37K, so that electrostatic latent images are formed on the photosensitive drums 36Y to 36K by being irradiated with the laser beam. The electrostatic latent images are developed by a reversal development by the developing rollers 34Y to 34K and the toner application rollers 35Y to 35K, and hence toner having a negative polarity is adhered thereto, so that toner images of yellow (Y), magenta (M), cyan (C), and black (K) are formed on the photosensitive drums 36Y to 36K.

The toner images in respective colors formed on the photosensitive drums 36Y to 36K are primarily transferred in sequence from the photosensitive drums 36Y to 36K to the intermediate transfer belt 39 in a stacked manner by an application of positive bias to the primary transfer rollers 40Y to 40K. The toner images in four colors that have been primarily transferred to the intermediate transfer belt 39 are conveyed to the secondary transfer roller 41 in a stacked state by the rotation of the intermediate transfer belt 39.

Simultaneously with the toner image forming operation described above, the sheets S stored in the feed cassette 20 are fed by the feed roller 21 and the separation roller 22 one by one to the registration roller pair 15. The printer 1 is configured to adjust timing of conveyance of the sheet for the secondary transfer of the images to the secondary transfer roller 41 while correcting a final skew of the sheet S by the registration roller pair 15. The sheet S conveyed to the secondary transfer roller 41 at predetermined timing of conveyance is subjected to a secondary transfer of the toner images in four colors on the intermediate transfer belt 39 by an application of a positive bias to the secondary transfer roller 41.

Toner remaining on the surfaces of the photosensitive drums 36Y to 36K after the transfer of the toner images is removed by drum cleaning blades 38Y, 38M, 38C, and 38K. Toner remaining on the intermediate transfer belt 39 after the secondary transfer to the sheet S is removed by the cleaning unit 42, and is collected into a waste toner collecting container, which is not illustrated.

The sheet S on which the toner image is transferred is conveyed to the fixing unit 43, and the toner images are fixed by being heated and pressed by the fixing roller 44 and the press roller 45. The sheet S on which the toner images are fixed is conveyed to the decurling roller pair 46 along the conveyance guide 47. At this time, if passage of the sheet S was supposed to be detected by the sheet detecting unit 7 but the sheet S is not detected after an elapse of a predetermined time, it is determined that jamming has occurred and hence a print job is stopped.

In contrast, since the sheet S detected within the predetermined time is decurled by the decurling roller pair 46, the sheet S is conveyed while being reduced in curl along the conveyance guide 16 to the discharge roller pair 13. At this time, if passage of the sheet S was supposed to be detected by the jamming detecting unit 8 but the sheet S is not detected after an elapse of the predetermined time, it is determined that jamming of the sheet has occurred at the decurling roller pair 46, and hence the print job is stopped. It is because if the next sheet is conveyed in a state in which the previous sheet is jammed at the decurling roller pair 46, wrapping of the sheet on the fixing roller 44 may occur, and hence detection by the jamming detecting unit 8 is required at a conveyance path immediately after the decurling roller pair 46.

The sheet S conveyed to the discharge roller pair 13 is discharged to the discharge tray 14 by the discharge roller pair 13 and is stacked on the discharge tray 14. When there is a command which instructs continuation of printing, the operation described above is repeated, and if not, the print job is terminated.

Figure 3:
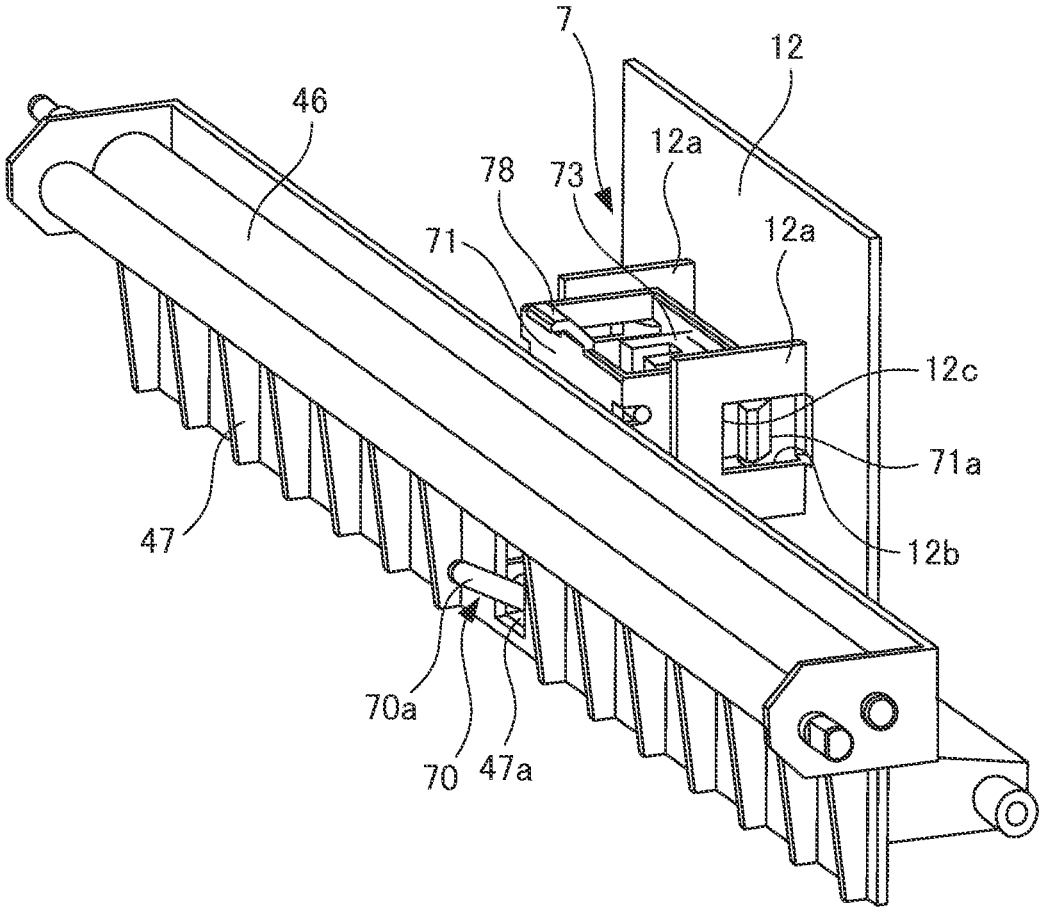
FIG. 3 is a perspective view illustrating a sheet detecting unit of the first embodiment.
Figure 4:
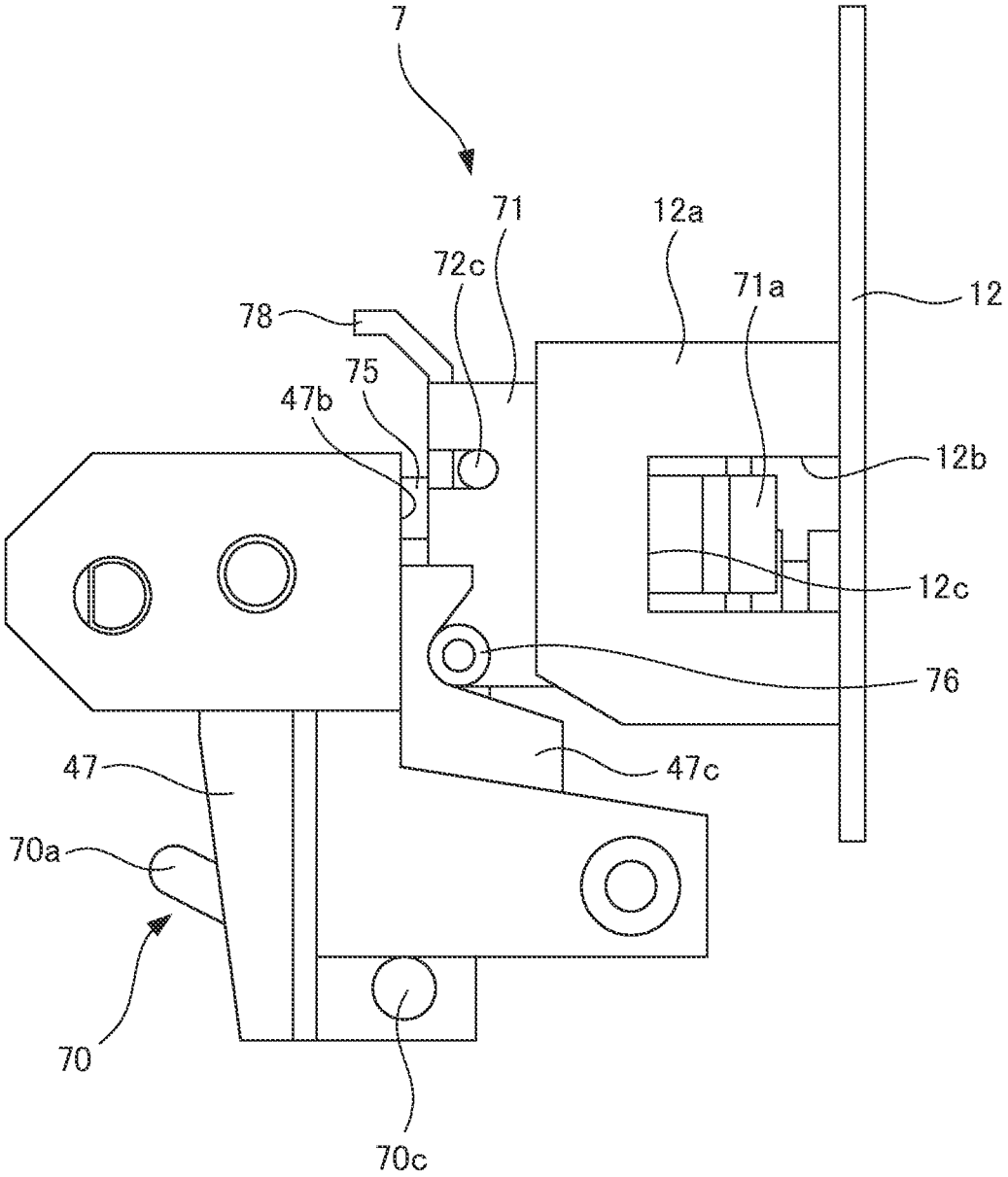
FIG. 4 is a side view illustrating the sheet detecting unit of the first embodiment.
Figure 5:
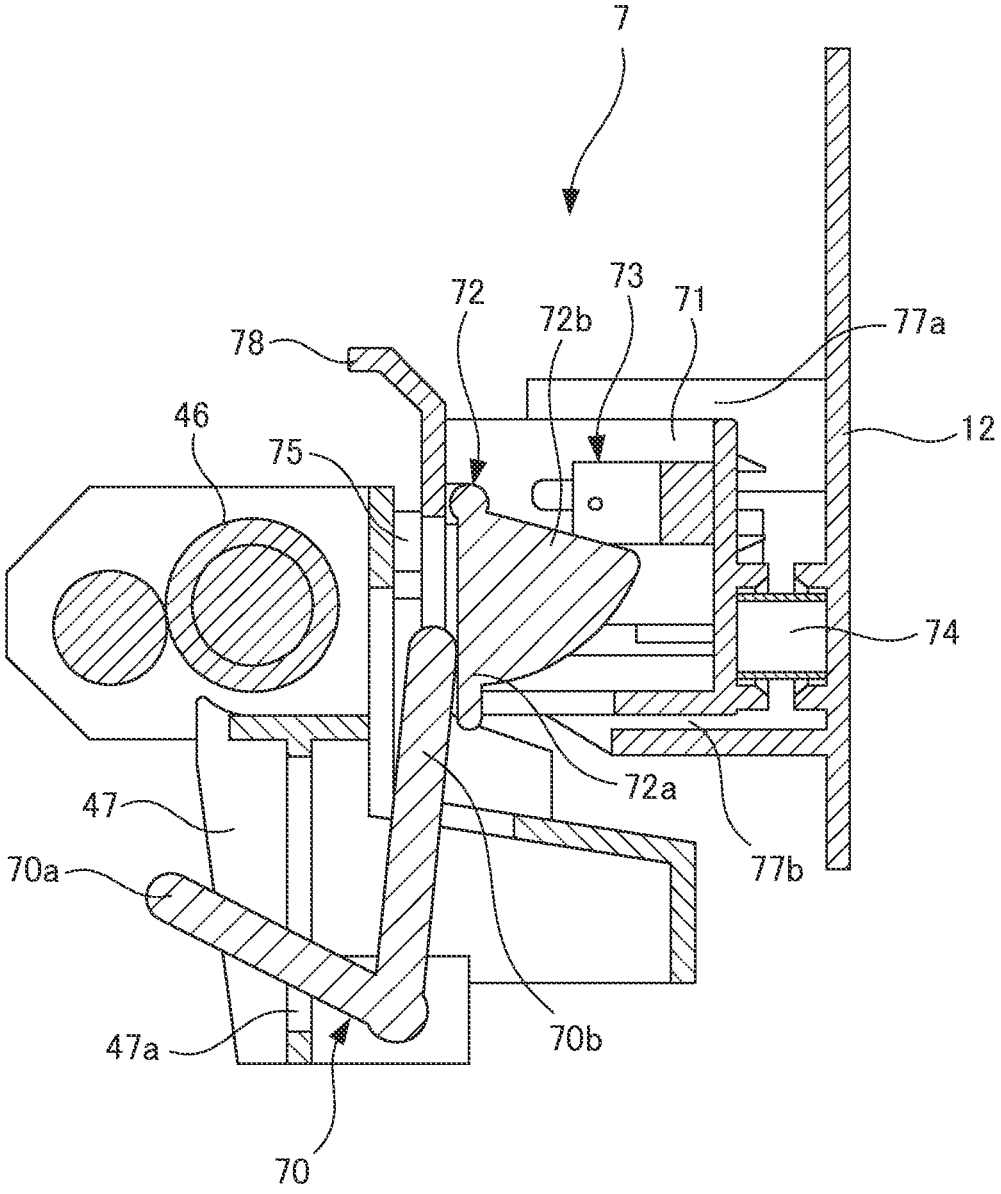
FIG. 5 is a cross-sectional view of the sheet detecting unit illustrated in FIG. 3.
Figure 6:
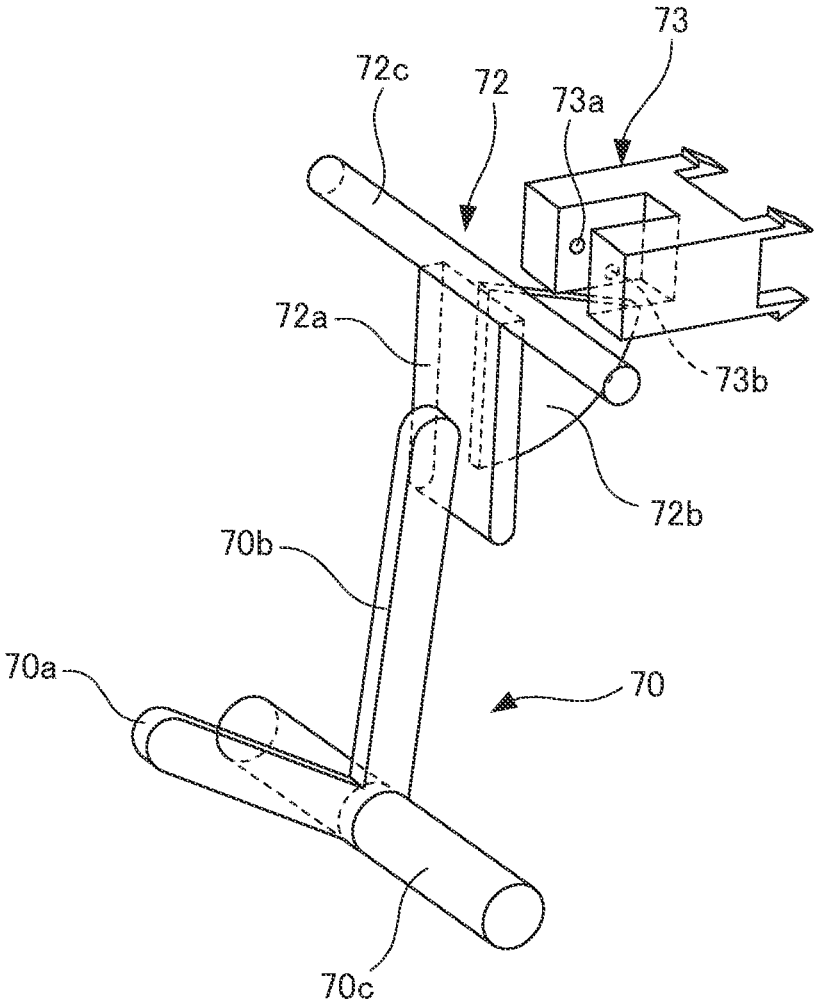
FIG. 6 is a perspective view illustrating a first detection lever and a second detection lever of the sheet detecting unit of the first embodiment.

Subsequently, the sheet detecting unit 7 described above will be described further in detail with reference to FIG. 3 to FIG. 7. First of all, a configuration of the sheet detecting unit 7 will be described with reference to FIG. 3 to FIG. 6. FIG. 3 is a perspective view illustrating the sheet detecting unit 7 of the first embodiment. FIG. 4 is a side view illustrating the sheet detecting unit 7 of the first embodiment. FIG. 5 is a cross-sectional view of the sheet detecting unit 7 illustrated in FIG. 4. FIG. 6 is a perspective view illustrating a first detection lever 70 and a second detection lever 72 of the sheet detecting unit 7 of the first embodiment.

As illustrated in from FIG. 3 to FIG. 5, the sheet detecting unit 7 includes the first detection lever 70 rotatably supported by the conveyance guide 47, and a positioning member 71 which functions as a second supporting member mounted on the inner cover 12 so as to come into contact with the conveyance guide 47 when the openable-and-closable cover (openable-and-closable portion) 11 is closed. The sheet detecting unit 7 is provided with the second detection lever 72 rotatably supported by the positioning member 71 and configured to move in conjunction with the first detection lever 70, and an optical sensor 73 which functions as a detection sensor mounted on the positioning member 71.

As illustrated in FIG. 6, the first detection lever 70 includes a first arm 70*a*, which functions as a contact portion configured to be capable of coming into contact with the sheet S moving in the sheet conveyance path along the conveyance guide 47, and a second arm 70*b*, which functions as an operating member configured to rotate the second detection lever 72. The first detection lever 70 includes a rotation shaft 70*c* configured to be rotatably supported by the conveyance guide 47. The first arm 70*a* extends from the rotation shaft 70*c* in a direction orthogonal to the direction of the axis of the rotation shaft 70*c*. The second arm 70*b* extends from the rotation shaft 70*c* in a direction offset from the first arm 70*a* by a predetermined angle. The rotation shaft 70*c* is supported by the conveyance guide 47 so that the first arm 70*a* is allowed to stick out from an opening 47*a* (see FIG. 5) formed in the conveyance guide 47 into the sheet conveyance path on the conveyance guide 47.

The first detection lever 70 is formed to have a weight balance in which the first arm 70*a* is allowed to stick out from the opening 47*a* under its own weight (the state illustrated in FIG. 3 and FIG. 4) when the rotation shaft 70*c* is supported by the conveyance guide 47. The opening 47*a* of the conveyance guide 47 is formed so that the first arm 70*a* is allowed to tilt in the direction of sheet conveyance (see FIG. 7 described later).

The second detection lever 72 includes a subject-to-contact portion 72*a* with which the second arm 70*b* may come into contact, a light-blocking portion 72*b* which is capable of blocking an infrared ray in the optical sensor 73, and an axis of rotation 72*c* rotatably supported by the positioning member 71. The subject-to-contact portion 72*a* extends from the axis of rotation 72*c* in a direction orthogonal to the axial direction of the axis of rotation 72*c*, and is formed to be wider than the width (thickness) of the second arm 70*b* considering rattling or tolerances of the respective members. In contrast to the first embodiment, the width of the second arm 70*b* may be wider than the width of the subject-to-contact portion 72*a*. The light-blocking portion 72*b* is formed into a fan shape having a center at the axis of rotation 72*c*. When the subject-to-contact portion 72*a* is pushed by the second arm 70*b* and rotates about the axis of rotation 72*c*, the infrared ray in the optical sensor 73 is blocked. The second detection lever 72 is formed to have a weight balance in which the light-blocking portion 72*b* does not block the infrared ray in the optical sensor 73 (the state illustrated in FIG. 4) when the axis of rotation 72*c* is supported by the positioning member 71.

As illustrated in FIG. 3 and FIG. 4, the positioning member 71 includes a pair of engaging portions 71*a* and 71*a*. The pair of engaging portions 71*a* and 71*a* are formed to be engageable with openings 12*b* and 12*b* formed in a pair of side plates 12*a* and 12*a* provided on the inner cover 12. The positioning member 71 is pressed in a direction away from the inner cover 12 by a compression spring 74 disposed between the positioning member 71 and the inner cover 12. Then, the pair of engaging portions 71*a* and 71*a* engage stopper portions 12*c* and 12*c* at ends of the openings 12*b* and 12*b* in the pressing direction, so that the movement in the pressing direction is restricted. In other words, the positioning member 71 can move by a distance corresponding to the length of the openings 12*b* and 12*b* in the pressing direction of the compression spring 74 and the direction opposite thereto. The positioning member 71 and the inner cover 12 are provided with spring seats so as to prevent buckling of the compression spring 74. The pair of engaging portions 71*a* and 71*a*, the openings 12*b* and 12*b*, and the compression spring 74 constitute a moving mechanism.

The positioning member 71 includes a pair of first abutting portions 75 and 75 configured to abut against a wall portion (contact portion) 47*b* of the conveyance guide 47, and a pair of second abutting portions 76 and 76 configured to abut against a pair of abutted portions 47*c* and 47*c* of the conveyance guide 47. When the openable-and-closable cover 11 is closed, the pair of first abutting portions 75 and 75 and the pair of abutted portions 47*c* and 47*c* abut against the conveyance guide 47, so that the positioning member 71 moves toward the inner cover 12 against an urging force of the compression spring 74, and is positioned. Then, the positioning member 71 is positioned, so that the subject-to-contact portion 72*a* of the second detection lever 72 abuts against the second arm 70*b* of the first detection lever 70 (see FIG. 5). In other words, when the openable-and-closable cover 11 is closed (in other words, at a closed position with respect to the main body of the image forming apparatus), the pair of first abutting portions 75 and 75 and the pair of abutted portions 47*c* and 47*c* abut against the conveyance guide 47, whereby the subject-to-contact portion 72*a* of the second detection lever 72 is positioned so as to come into contact with the second arm 70*b* of the first detection lever 70.

The pair of abutted portions 47*c* and 47*c* of the conveyance guide 47 is formed into a guiding shape that guides the pair of second abutting portions 76 and 76 of the positioning member 71 to predetermined positions. Also, the positioning member 71 is configured not to come into contact with the inner cover 12 by means of spaces 77*a* and 77*b* provided respectively on an upper side and a lower side thereof. In addition, a projecting portion 78 extending toward the conveyance guide 47 is provided on an upper portion of the positioning member 71.

The optical sensor 73 includes a transmitting portion 73*a* which functions as a light-emitting portion configured to transmit an infrared ray, and a receiving portion 73*b* which functions as a light receiving portion configured to receive the infrared ray transmitted from the transmitting portion 73*a*. The transmitting portion 73*a* and the receiving portion 73*b* are arranged so as to face each other. The optical sensor 73 is also configured to emit a predetermined detection signal when the infrared ray that the receiving portion 73*b* receives is blocked by the light-blocking portion 72*b* of the second detection lever 72. In other words, the optical sensor 73 is configured to be operated in accordance with an interlocking operation of the first detection lever.

Figure 7:
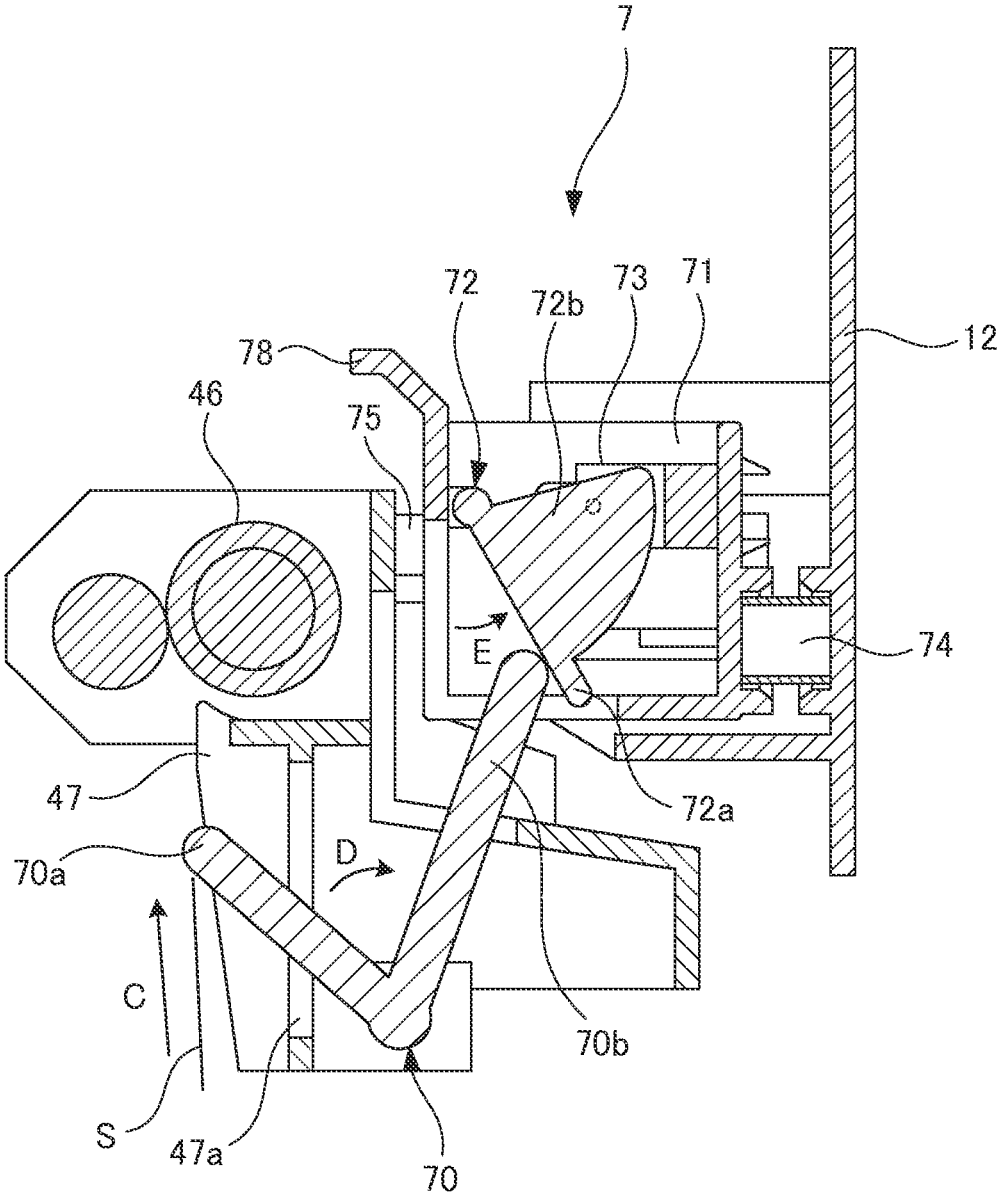
FIG. 7 is a cross-sectional view illustrating a state of sheet detection performed by the sheet detecting unit of the first embodiment.

Subsequently, detection of the sheet S by the sheet detecting unit 7 configured as described above will be described with reference to FIG. 7. FIG. 7 is a cross-sectional view illustrating a state in which the sheet is detected by the sheet detecting unit 7 of the first embodiment.

As illustrated in FIG. 7, when the sheet S to which a toner images are fixed by the fixing roller 44 and the press roller 45 is moved along the conveyance guide 47 in a direction indicated by an arrow C in FIG. 7, a distal end of the sheet S abuts against the first arm 70*a* of the first detection lever 70. When the sheet S abuts against the first arm 70*a*, the first arm 70*a* and the second arm 70*b* are pushed by the sheet S, and are rotated integrally about the rotation shaft 70*c* in a direction indicated by an arrow D. When the second arm 70*b* rotates in the direction indicated by the arrow D, the subject-to-contact portion 72*a* that is in abutment with the second arm 70*b* is pushed by the second arm 70*b*, and the second detection lever 72 rotates in a direction indicated by an arrow E. Accordingly, the infrared ray that the receiving portion 73*b* of the optical sensor 73 receives is blocked by the light-blocking portion 72*b* of the second detection lever 72. The optical sensor 73 in which the infrared ray is blocked emits a predetermined detection signal, and the control unit 6 receives the detection signal, so that passage of the sheet S is detected.

In order to arrange the optical sensor away from the fixing unit, it is conceivable to use a single detection lever in which the sheet detecting unit configured to come into contact with the sheet and the single detection lever configured to block light in the optical sensor are arranged away from each other in the direction of the rotating shaft. However, in this case, bending moment generated on the shaft of the detection lever is increased, and hence the detection accuracy may be lowered. In addition, since the effect of the thermal deformation of the detection lever is increased, the detection accuracy may be lowered.

In contrast, according to the first embodiment, as described thus far, in a printer 1, the first arm 70*a* and the second arm 70*b* of the first detection lever 70 are offset by a predetermined angle in the circumferential direction so that positions in the circumferential direction of the rotation shaft 70*c* are different at the same axial position of the rotation shaft 70*c*. Therefore, a portion from the first arm 70*a* configured to detect the passage of the sheet to the optical sensor 73 may be arranged so as to match the direction of rotation (the direction of power transmission) substantially linearly. In other words, since the first arm (contact portion) 70*a* and the second arm (operating portion) 70*b* of the first detection lever 70 and the subject-to-contact portion 72*a* and the light-blocking portion 72*b* of the second detection lever 72 are disposed so that the positions thereof in the direction of the rotating shaft are aligned substantially linearly, the sheet may be detected with a configuration in which the bending moments generated in the rotation shafts 70*c* and 72*c* are minimized.

In addition, the lengths of the respective arm members 70*a*, 70*b*, 72*a*, and 72*b* may be minimized by the second detection lever 72 provided between the first detection lever 70 and the optical sensor 73 separately from the first detection lever. Accordingly, the strengths, the workabilities, and working accuracies of the respective arm members 70*a*, 70*b*, 72*a*, and 72*b* may be improved, and the effect of thermal deformation of the arms on the detection accuracy may be reduced.

In addition, with an advantage that the above-described bending moment generated in the axial direction is small combined with an advantage that the lengths of the arm members 70*a*, 70*b*, 72*a*, and 72*b* may be minimized, the likelihood that the arm or the like is broken at the time of assembly or at the time of clearing the jam may be lowered. Also, since the lengths of the arm members 70*b* and 72*a* may be reduced, the amount of projection of the arm member 70*b* from the main body 10 (and the arm 72*a* from the openable-and-closable cover 11) may be reduced, so that the likelihood of breakage of the arm is low.

Furthermore, since the detection levers 70 and 72 are configured as described above, the optical sensor 73 may be arranged in the openable-and-closable cover 11 (the inner cover 12) located away from the fixing roller (heat source) 44, and the failure of the optical sensor 73 due to radiation heat of the fixing roller may be prevented and an erroneous operation of the optical sensor 73 due to moisture vapor generated from the sheet at the time of heat fixation may also be prevented.

In the printer 1, when the openable-and-closable cover 11 is closed, the positioning member 71 is positioned so that the second detection lever 72 is allowed to move in conjunction with the rotation of the first detection lever 70 by abutment of the pair of first abutting portions 75 and 75 and the pair of abutted portions 47*c* and 47*c* against the conveyance guide 47. In the first embodiment, when the openable-and-closable cover 11 is closed, the second detection lever 72 is positioned at a position coming into contact with the first detection lever 70. Therefore, positioning is achieved easily and the positional accuracies of the second arm 70*b* and the optical sensor 73 may be improved even when the second arm 70*b* and the optical sensor 73 are provided on the openable-and-closable cover 11.

In the printer 1, the first detection lever 70 is arranged in the main body 10, and the second detection lever 72 configured to operate the optical sensor 73 and the optical sensor 73 are arranged in the openable-and-closable cover 11. Therefore, since it is not necessary to demount the optical sensor 73 or the like at the time of replacement in service for the fixing unit 43, the cost of the replacement in service may be reduced. Even in a configuration in which the second detection lever 72 and the optical sensor 73 are arranged in the openable-and-closable cover 11, the positioning member 71 configured to support the second detection lever 72 and the optical sensor 73 is positioned by an abutment against the apparatus body, whereby lowering of the sheet detection accuracy is prevented. Arrangement of the second detection lever 72 and the optical sensor 73 on the openable-and-closable cover 11 contributes also to prevention of increase in size of the image forming apparatus even though the optical sensor 73 is arranged at a position away from the fixing unit 43.

Figure 8:
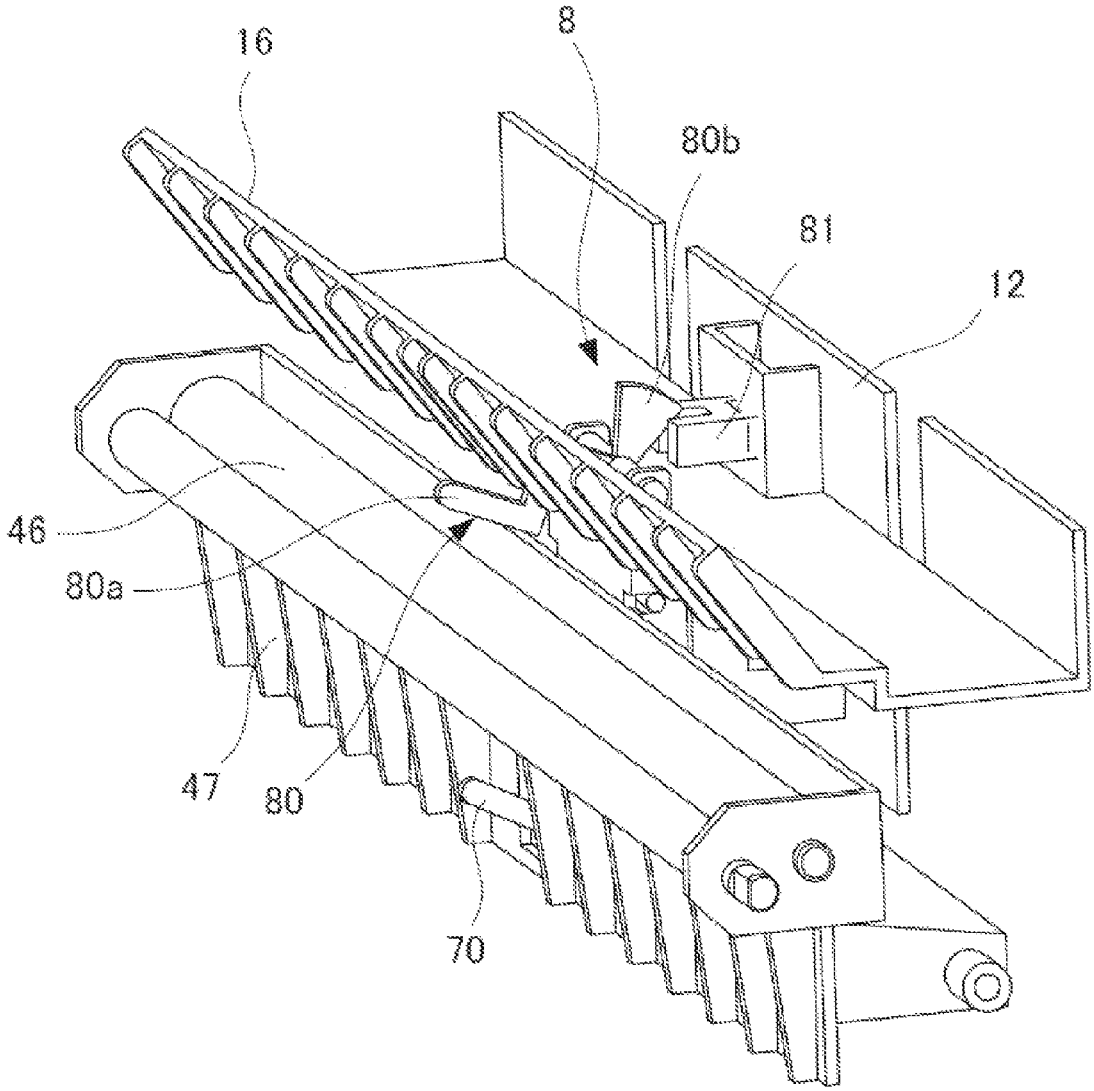
FIG. 8 is a perspective view illustrating the sheet detecting unit and a jamming detecting unit of the first embodiment.
Figure 9:
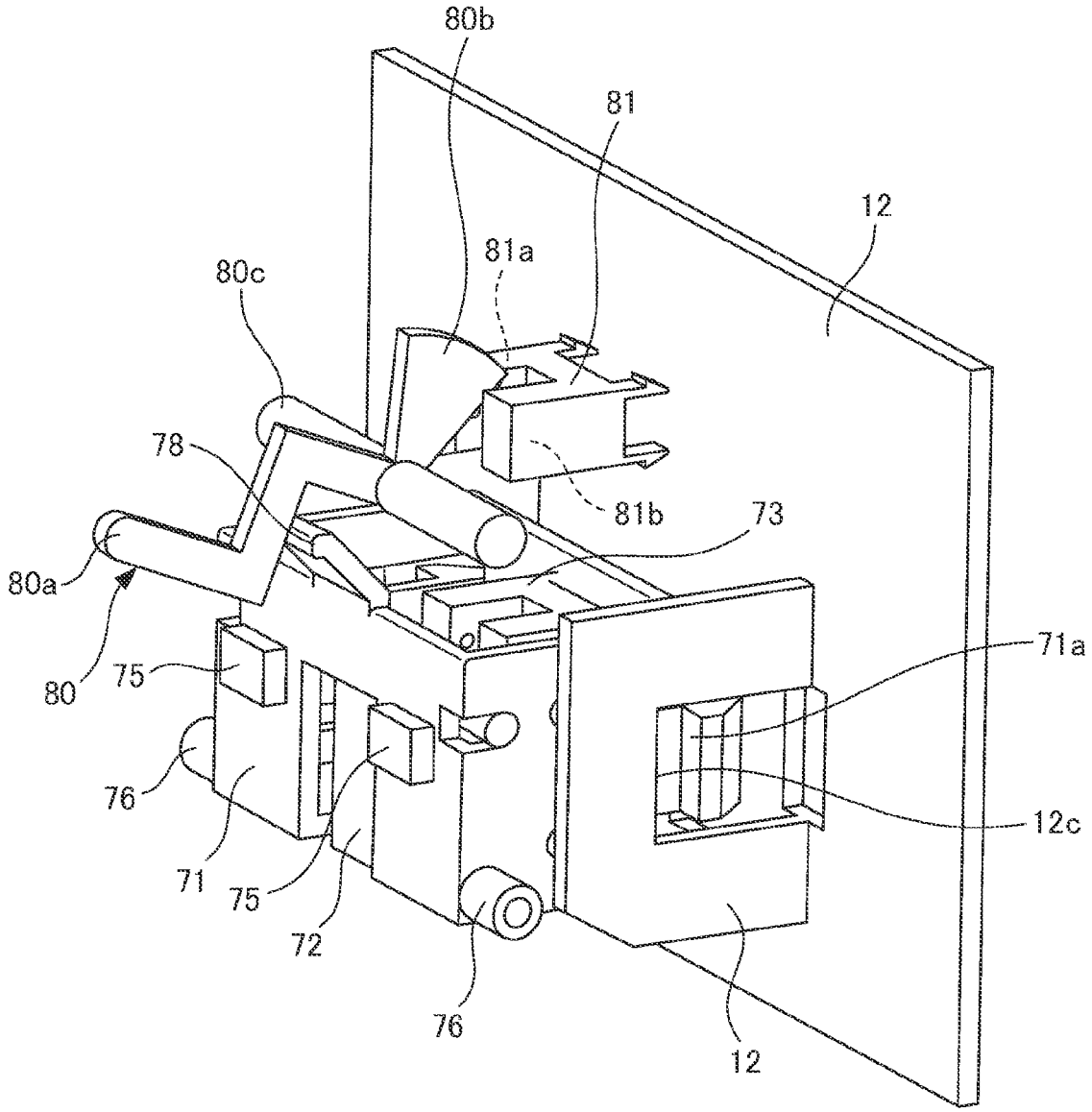
FIG. 9 is a perspective view illustrating the jamming detecting unit of the first embodiment.

Subsequently, the jamming detecting unit 8 described above will be described further in detail with reference to FIG. 8 to FIG. 11. First of all, a configuration of the jamming detecting unit 8 will be described with reference to FIG. 8 and FIG. 9. FIG. 8 is a perspective view illustrating the sheet detecting unit 7 and the jamming detecting unit 8 of the first embodiment. FIG. 9 is a perspective view illustrating the jamming detecting unit 8 of the first embodiment.

As illustrated in FIG. 8 and FIG. 9, the jamming detecting unit 8 includes a jamming detection lever 80, which functions as a rotating member, rotatably supported by a conveyance guide 16 that is mounted on the openable-and-closable cover 11. The jamming detecting unit 8 also includes a jamming detection sensor (photo interrupter) 81 mounted on the conveyance guide 16 and operated by the jamming detection lever 80. The jamming detection lever 80 includes an arm portion 80*a* that comes into contact with the sheet S moving along the conveyance guide 16 in the sheet conveyance path, a light-blocking portion 80*b* that blocks the infrared ray in the jamming detection sensor 81, and a rotating shaft 80*c* rotatably supported by the conveyance guide 16.

The arm portion 80*a* includes a contact surface 80*d* with which the sheet S comes into contact and a pressed surface 80*e* that the projecting portion 78 provided on the upper portion of the positioning member 71 can press, and extends in a direction orthogonal to the axial direction of the rotating shaft 80*c*. The light-blocking portion 80*b* is formed into a fan shape having a center at the rotating shaft 80*c*. When the contact surface 80*d* is pushed by the sheet S and the arm portion 80*a* rotates, the infrared ray in the jamming detection sensor 81 is blocked. The rotating shaft 80*c* is supported by the conveyance guide 16 so that the contact surface 80*d* of the arm portion 80*a* is allowed to protrude from an opening 16*a* formed in the conveyance guide 16 into the sheet conveyance path on the conveyance guide 16.

The jamming detection sensor 81 includes a transmitting portion 81*a* configured to transmit an infrared ray and a receiving portion 81*b* configured to receive the infrared ray transmitted from the transmitting portion 81*a*, and the transmitting portion 81*a* and the receiving portion 81*b* are arranged so as to face each other. The jamming detection sensor 81 is also configured to emit a predetermined detection signal when the infrared ray that the receiving portion 81*b* receives is blocked by the light-blocking portion 81*b* of the jamming detection lever 80.

Figure 10:
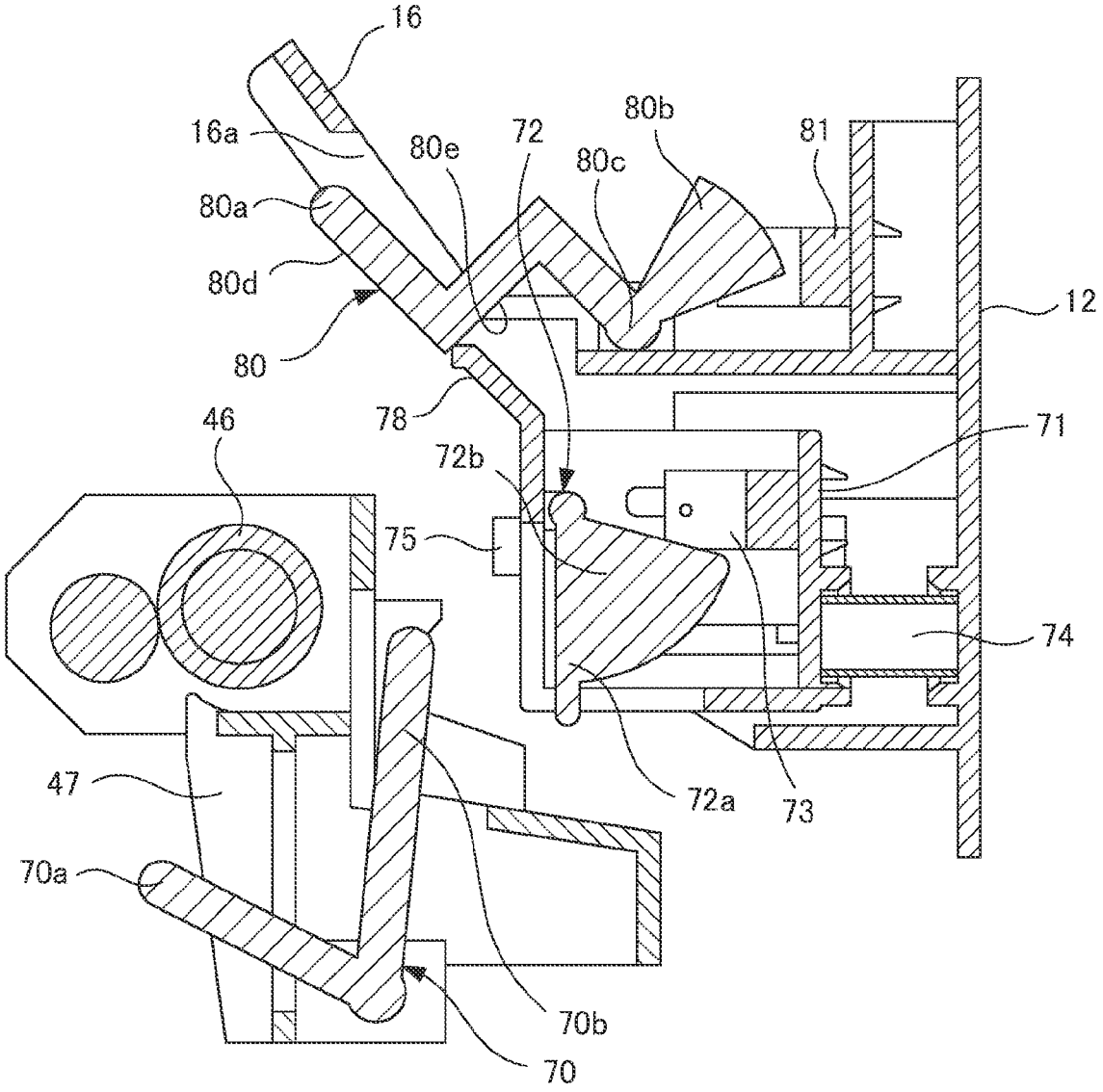
FIG. 10 is a cross-sectional view illustrating the sheet detecting unit and the jamming detecting unit of the first embodiment.
Figure 11:
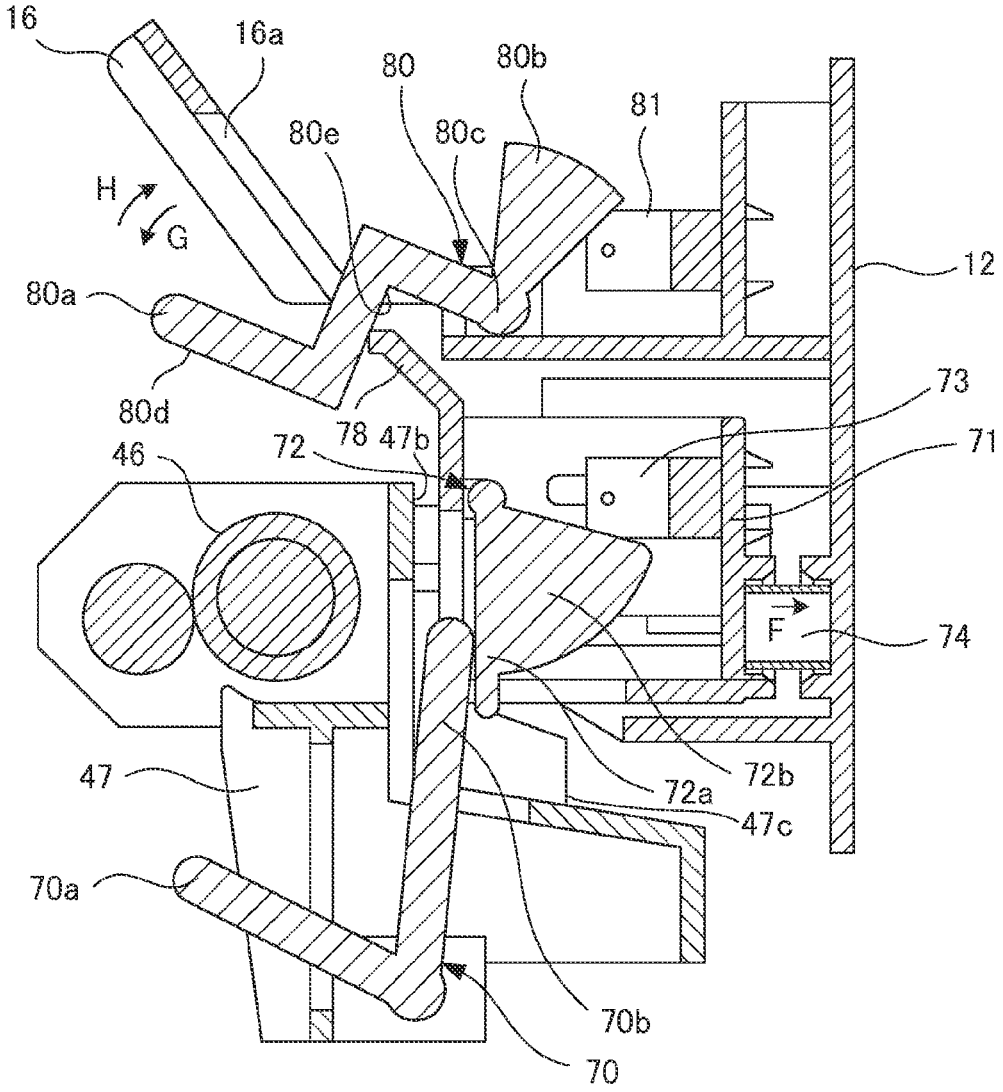
FIG. 11 is a cross-sectional view illustrating the sheet detecting unit and the jamming detecting unit of the first embodiment.

Subsequently, in the sheet detecting unit 7 and the jamming detecting unit 8 configured as described above, an operation for positioning the sheet detecting unit 7 and the jamming detection lever 80 when the openable-and-closable cover 11 is closed will be described with reference to FIG. 10 and FIG. 11. FIG. 10 is a cross-sectional view illustrating the sheet detecting unit 7 and the jamming detecting unit 8 of the first embodiment. FIG. 11 is a cross-sectional view illustrating the sheet detecting unit 7 and the jamming detecting unit 8 of the first embodiment.

As illustrated in FIG. 10, in a state in which the openable-and-closable cover 11 is opened, the arm portion 80*a* is positioned at a retracted position (second position) where the pressed surface 80*e* is pushed by the projecting portion 78 and the contact surface 80*d* is retracted from the sheet conveyance path on the conveyance guide 16. In contrast, when the openable-and-closable cover 11 is closed, the positioning member 71 moves in a direction indicated by an arrow F illustrated in FIG. 11 against an urging force of the compression spring 74. It is because the first abutting portion 75 of the positioning member 71 abuts against the wall portion 47*b* of the conveyance guide 47, and the second abutting portion 76 of the positioning member 71 abuts against the abutted portion 47*c* of the conveyance guide 47. When the positioning member 71 moves in the direction indicated by the arrow F, the projecting portion 78 also moves in the direction indicated by the arrow F as illustrated in FIG. 11. Therefore, the jamming detection lever 80 rotates about the rotating shaft 80*c* in a direction indicated by an arrow G, so that a detecting position (first position) where the contact surface 80*d* protrudes into the sheet conveyance path on the conveyance guide 16 is achieved.

In other words, the arm portion 80*a* is configured in such a manner that when the openable-and-closable cover 11 is opened, the pressed surface 80*e* is pushed by the projecting portion 78 and hence the contact surface 80*d* is retracted from the sheet conveyance path. In contrast, when the openable-and-closable cover 11 is closed, the contact surface 80*d* protrudes into the sheet conveyance path. The urging force of the compression spring 74 is set to be sufficiently larger than a force applied to the jamming detection lever 80 in the direction indicated by the arrow G.

Subsequently, detection of the sheet S by the jamming detecting unit 8 configured as described above will be described with reference to FIG. 11. As illustrated in FIG. 11, when the sheet S decurled by the decurling roller pair 46 passes through nip of the decurling roller pair 46, the distal end of the sheet S abuts against the contact surface 80*d* of the arm portion 80*a*. When the sheet S abuts against the contact surface 80*d*, the jamming detection lever 80 is pushed by the sheet S and rotates in a direction indicated by an arrow H. When the jamming detection lever 80 rotates in the direction indicated by the arrow H, an infrared ray in the jamming detection sensor 81 is blocked. The jamming detection sensor 81 in which the infrared ray is blocked emits a predetermined detection signal, and the control unit 6 receives the detection signal, so that passage of the sheet S is detected.

As described above, the printer 1 is configured in such a manner that when the openable-and-closable cover 11 is opened, the pressed surface 80*e* of the jamming detection lever 80 is pressed by the projecting portion 78 of the positioning member 71 and the contact surface 80*d* is retracted from the sheet conveyance path. Therefore, breakage of the jamming detection lever 80 that may occur when the openable-and-closable cover 11 is opened for clearing the jam may be prevented.

Second Embodiment

Subsequently, a printer 1A of a second embodiment of this disclosure will be described with reference to from FIG. 12 to FIG. 15 with an aid of FIG. 1. The printer 1A of the second embodiment is different from the first embodiment in that a non-contact sensor is provided at the jamming detecting unit. Therefore, in the second embodiment, points different from the first embodiment, that is, the non-contact sensor in the jamming detecting unit is mainly described, and the configurations which are the same as the first embodiment are denoted by the same reference signs and description thereof will be omitted.

Figure 12:
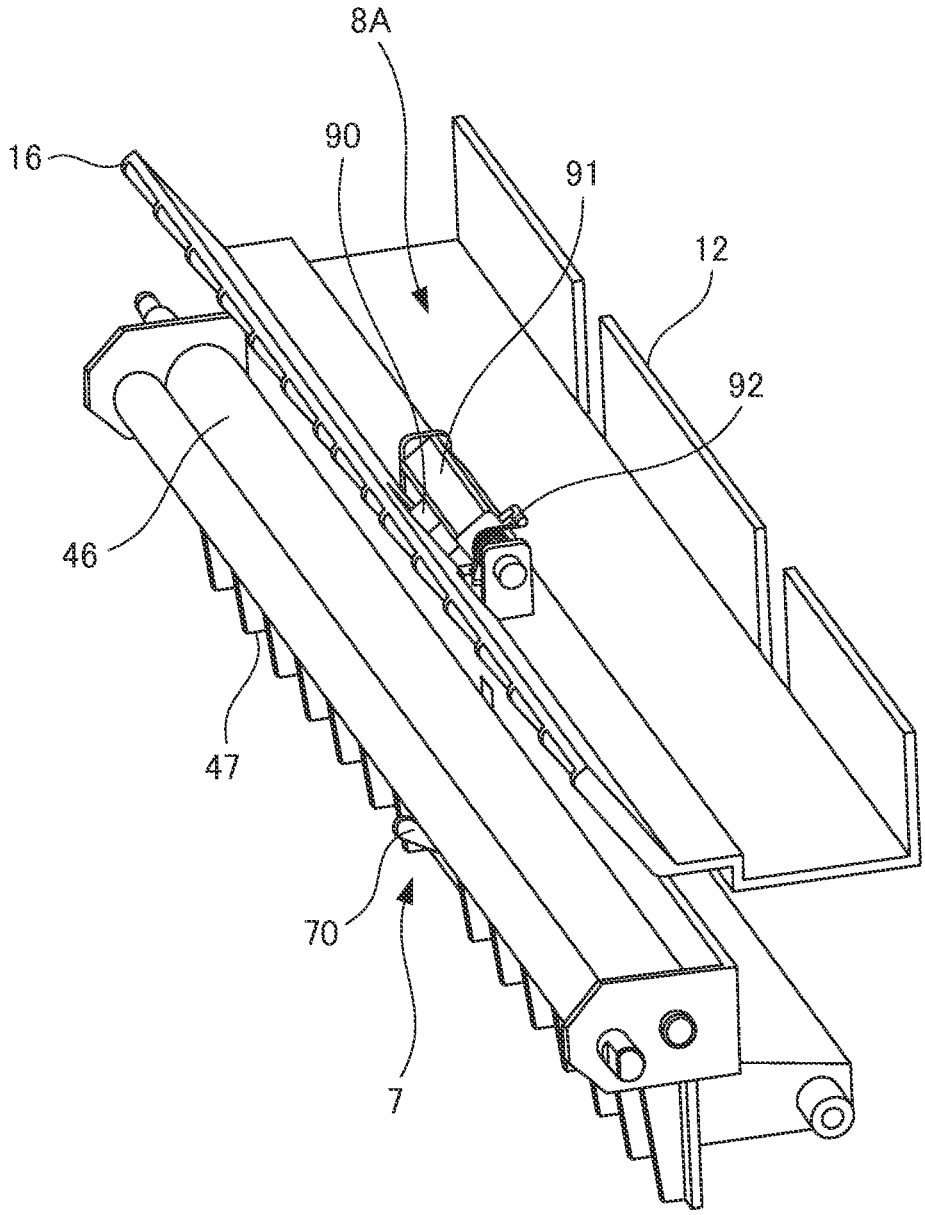
FIG. 12 is a perspective view illustrating a sheet detecting unit and a jamming detecting unit of a second embodiment.
Figure 13:
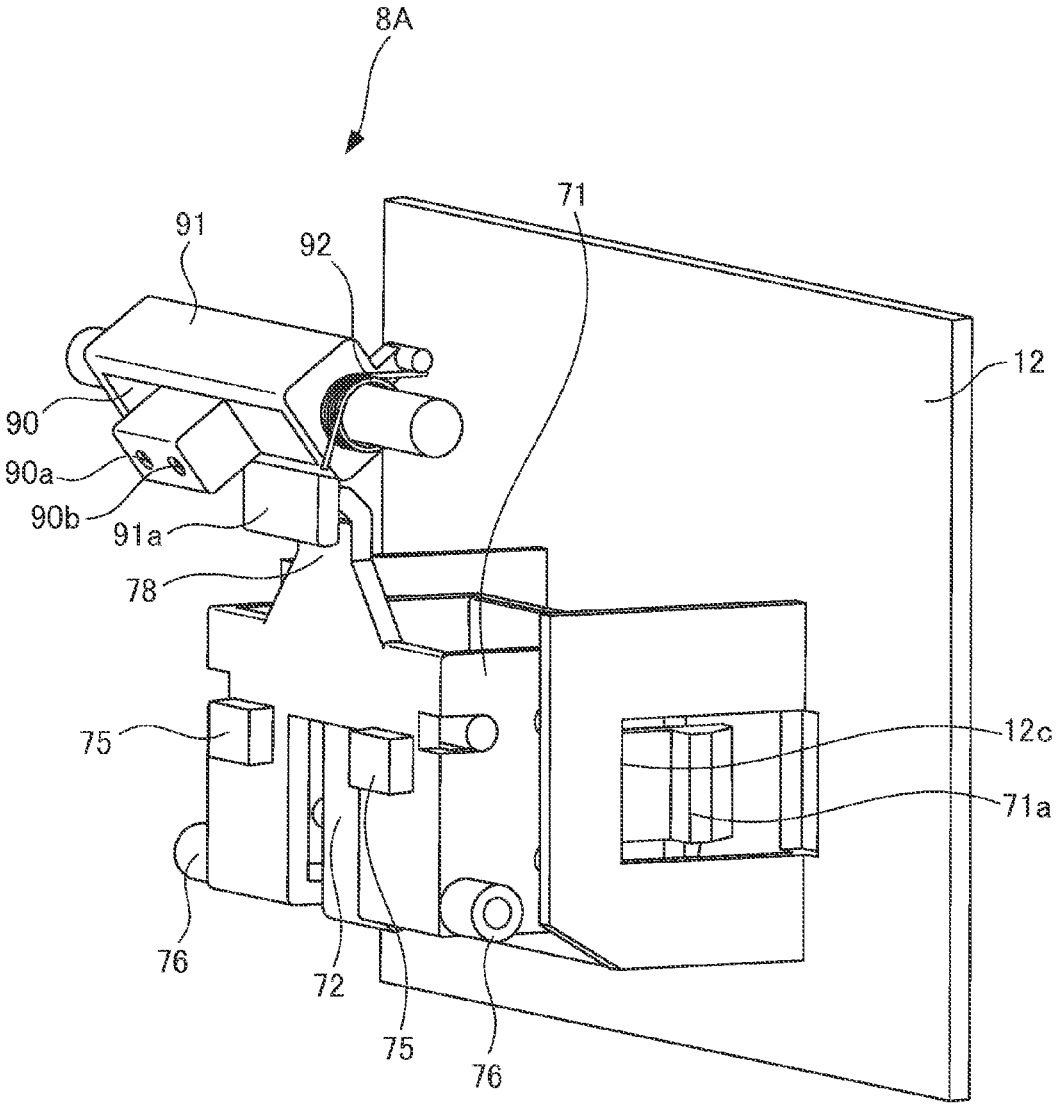
FIG. 13 is a perspective view illustrating the jamming detecting unit of the second embodiment.

First of all, a general configuration of the printer 1A of the second embodiment will be described with reference to FIG. 1, FIG. 12, and FIG. 13. FIG. 12 is a perspective view illustrating the sheet detecting unit 7 and a jamming detecting unit 8A of the second embodiment. FIG. 13 is a perspective view illustrating the jamming detecting unit 8A of the second embodiment.

As illustrated in FIG. 1, the printer 1A includes the main body 10 and the openable-and-closable cover 11. The main body 10 includes the sheet feeding unit 2, an image forming unit 3A, the discharge roller pair 13, the discharge tray 14, and the control unit 6. The image forming unit 3A includes the process cartridges 30Y to 30K, the exposure apparatus 31, the intermediate transfer belt 39, the primary transfer rollers 40Y to 40K, the cleaning unit 42, and a fixing unit 43A. The fixing unit 43A includes the fixing roller 44 and the press roller 45 as the fixing unit, the sheet detecting unit 7, the decurling roller pair 46, and the jamming detecting unit 8A provided downstream of the decurling roller pair 46.

As illustrated in FIG. 12 and FIG. 13, the jamming detecting unit 8A includes a non-contact sensor 90 configured to detect the presence or absence of the sheet S, and a sensor holder 91 configured to support the non-contact sensor 90. The non-contact sensor 90 is provided with a transmitting portion 90*a* and a receiving portion 90*b*, and the presence or absence of the sheet S is detected by receiving an infrared ray emitted from the transmitting portion 90*a* and reflected by the sheet S by the receiving portion 90*b*.

The sensor holder 91 has rotating shafts at both ends thereof, and the rotating shafts are rotatably supported by the conveyance guide 16. The rotating shafts are urged in the direction opposite to the direction of seat conveyance by a coil spring 92, and the coil spring 92 engages the sensor holder 91 and the conveyance guide 16. The sensor holder 91 is provided with an abutting portion 91*a*, and the abutting portion 91*a* abuts against the projecting portion 78 of the positioning member 71 by an urging force of the coil spring 92.

Figure 14:
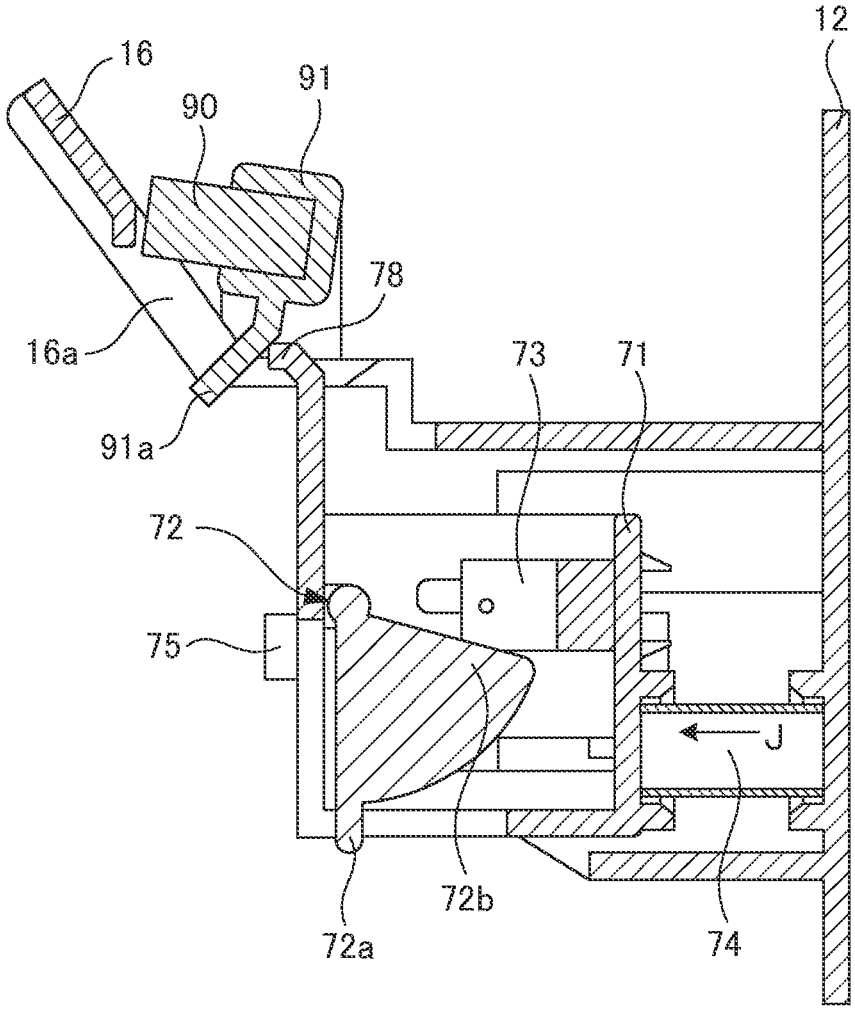
FIG. 14 is a cross-sectional view illustrating the sheet detecting unit and the jamming detecting unit of the second embodiment.
Figure 15:
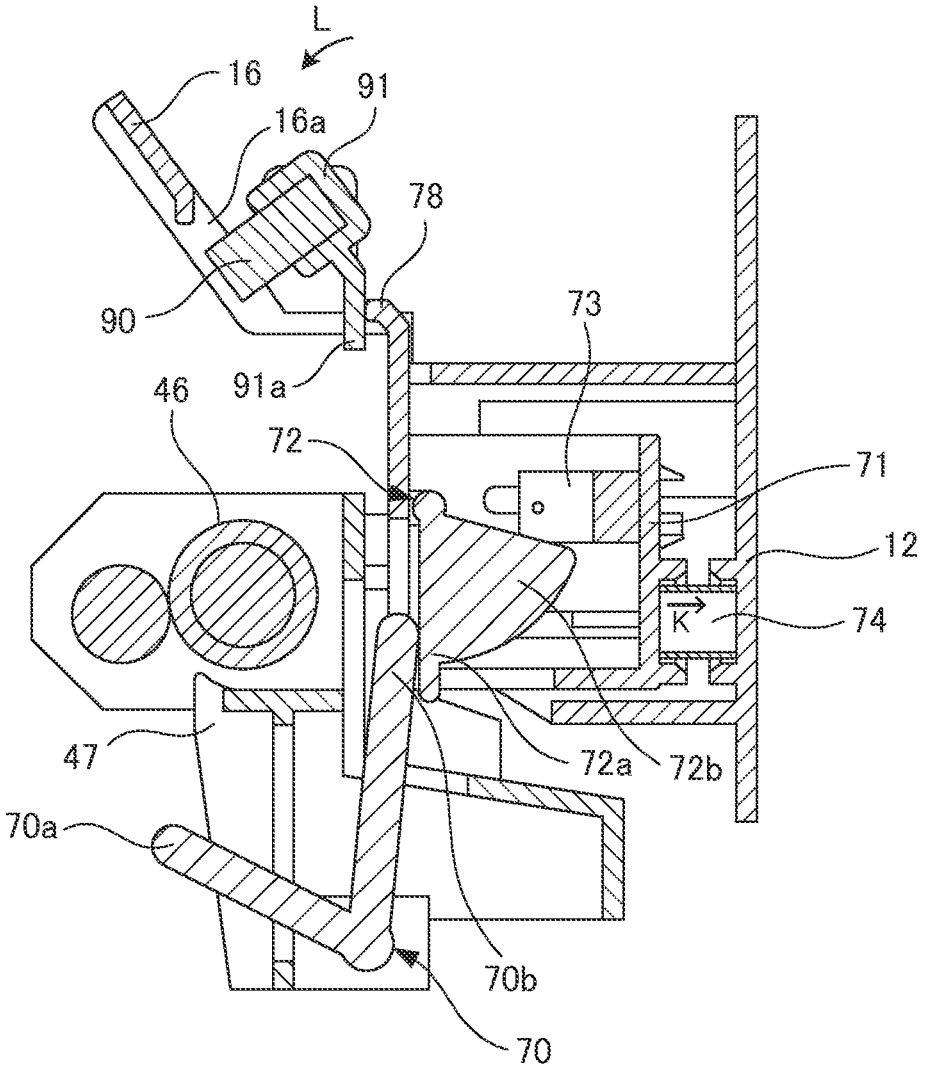
FIG. 15 is a cross-sectional view illustrating the sheet detecting unit and the jamming detecting unit of the second embodiment.

Subsequently, in the jamming detecting unit 8A configured as described above, an operation for positioning the non-contact sensor 90 when the openable-and-closable cover 11 is closed will be described with reference to FIG. 14 and FIG. 15. FIGS. 14 and 15 are cross-sectional views illustrating the sheet detecting unit 7 and the jamming detecting unit 8A of the second embodiment.

As illustrated in FIG. 14, in the state in which the openable-and-closable cover 11 is opened, the sensor holder 91 is in a state in which the abutting portion 91*a* is pressed by the projecting portion 78, and the transmitting portion 90*a* and the receiving portion 90*b* of the non-contact sensor 90 are retracted from the sheet conveyance path on the conveyance guide 16. More specifically, when the openable-and-closable cover 11 is opened, the positioning member 71 moves in a direction indicated by an arrow J by an urging force of the compression spring 74. The movement of the positioning member 71 is stopped by engagement of the engaging portion 71*a* with the stopper portion 12*c*. In association with the movement of the positioning member 71, the projecting portion 78 also moves in the direction indicated by the arrow J. When the projecting portion 78 is moved in the direction indicated by the arrow J, the abutting portion 91*a* is pressed by the projecting portion 78, and the sensor holder 91 rotates. When the sensor holder 91 rotates, the non-contact sensor 90 rotates, and the transmitting portion 90*a* and the receiving portion 90*b* of the non-contact sensor 90 are in a state of being retracted to the inside of the conveyance guide 16.

Subsequently, when the openable-and-closable cover 11 is closed, the positioning member 71 moves in a direction indicated by an arrow K illustrated in FIG. 15 against the urging force of the compression spring 74. When the positioning member 71 moves in the direction indicated by the arrow K, the projecting portion 78 also moves in the direction indicated by the arrow K as illustrated in FIG. 15. Therefore, the non-contact sensor 90 rotates in a direction indicated by an arrow L, so that the transmitting portion 90*a* and the receiving portion 90*b* are in a state of being protruded into the sheet conveyance path on the conveyance guide 16. In other words, the non-contact sensor 90 is configured in such a manner that when the openable-and-closable cover 11 is opened, the abutting portion 91*a* is pressed by the projecting portion 78, and the transmitting portion 90*a* and the receiving portion 90*b* are retracted from the sheet conveyance path, and when the openable-and-closable cover 11 is closed, the transmitting portion 90*a* and the receiving portion 90*b* protrude into the sheet conveyance path.

As illustrated above, the printer 1A is configured in such a manner that when the openable-and-closable cover 11 is opened, the transmitting portion 90*a* and the receiving portion 90*b* of the non-contact sensor 90 are retracted from the sheet conveyance path to the inside of the conveyance guide 16. Therefore, when the openable-and-closable cover 11 is opened for clearing the jam, the transmitting portion 90*a* and the receiving portion 90*b* of the non-contact sensor 90 may be protected from paper powder, dust, or the like. Accordingly, the infrared ray is prevented from being blocked by the paper powder, dust, or the like, and an erroneous operation of the non-contact sensor 90 is prevented. Breakage of the non-contact sensor 90 or the sensor holder 91 that may occur when the openable-and-closable cover 11 is opened for clearing the jam is prevented.

The embodiments of this disclosure have been described thus far. However, this disclosure is not limited to the embodiments described above. In the advantages described in the embodiments of this disclosure, only examples of the most preferable advantages that this disclosure brings about are listed, and the advantages of this disclosure are not limited to those described in the embodiments of this disclosure.

For example, in the second embodiment, the first detection lever 70, the second detection lever 72, and the jamming detection lever 80 are configured to take the positions for detecting the sheet S under their own weights. However, this disclosure is not limited thereto. A configuration in which an urging member such as a coil spring is used for achieving the detecting position is also applicable. By using the urging member, an erroneous detection caused by chattering of the first detection lever 70, the second detection lever 72, and the jamming detection lever 80 is prevented.

Although the compression spring 74 is employed at the abutting portion of the positioning member 71 against the conveyance guide 47, resilient members such as sponge or rubber, or the self-weight of the positioning member may also be employed.

In the first embodiment, light in the optical sensor is blocked by rotating the second detection lever. However, this disclosure is not limited thereto. For example, a configuration in which the second detection lever is slid to block the light in the optical sensor would also be satisfactory.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-017482, filed on Jan. 31, 2013, and 2014-005430, filed on Jan. 15, 2014 which are hereby incorporated by reference herein in their entirety.

What is claimed is:

1. An image forming apparatus comprising:

a main body including a toner image forming portion configured to form a toner image, a fixing portion configured to heat and fix the toner image formed by the toner image forming portion to a sheet, a first detection lever configured to be moved by being pushed by the sheet on which the toner image is fixed, and a first supporting member configured to movably support the first detection lever; and a cover portion movably supported by the main body and including a second detection lever configured to move in conjunction with a movement of the first detection lever, a second supporting member configured to support the second detection lever, and a detection sensor configured to be activated in accordance with a movement of the second detection lever, the cover portion being configured at a closed position with respect to the main body to cause the second supporting member to come into contact with the first supporting member, and the second supporting member to be positioned so as to allow the second detection lever to move in conjunction with the movement of the first detection lever.

2. The image forming apparatus according to claim 1, wherein the second supporting member supports the detection sensor.

3. The image forming apparatus according to claim 1, wherein the detection sensor includes a light-emitting portion and a light-receiving portion, wherein the first detection lever includes a contact portion configured to come into contact with the sheet on which the toner image is fixed, and an activating portion configured to move integrally with the contact portion to move the second detection lever, and wherein the second detection lever includes a subject-to-contact portion with which the activating portion comes into contact, and a light-blocking portion configured to move integrally with the subject-to-contact portion that moves in conjunction with the activating portion to block light between the light-emitting portion and the light-receiving portion in a state in which the cover portion is at the closed position.

4. The image forming apparatus according to claim 3, wherein the first detection lever and the second detection lever are rotated, and wherein the contact portion and the activating portion of the first detection lever and the subject-to-contact portion and the light-blocking portion of the second detection lever are disposed such that positions in a direction of an axis of rotation are aligned substantially linearly.

5. The image forming apparatus according to claim 4, wherein the second supporting member supports the detection sensor.

6. The image forming apparatus according to claim 5, wherein the cover portion includes a moving mechanism configured to cause the second supporting member to project in a state in which the cover portion is opened, and a detecting unit configured to be positioned at a first position where the sheet moving in the sheet conveyance path is detectable in a state in which the cover portion is closed, and move to a second position that is retracted from the first position by being pressed by the second supporting member in a state in which the cover portion is opened.

7. The image forming apparatus according to claim 1, wherein the cover portion includes a moving mechanism configured to cause the second supporting member to project in a state in which the cover portion is opened, and a detecting unit configured to be positioned at a first position where the sheet moving in the sheet conveyance path is detectable in a state in which the cover portion is closed, and move to a second position that is retracted from the first position by being pressed by the second supporting member in a state in which the cover portion is opened.

8. The image forming apparatus according to claim 7, wherein the detecting unit includes a photo interrupter, and a rotating member configured to activate the photo interrupter by being pressed by the sheet that is conveyed and move to the second position by being pressed by the second supporting member.

9. The image forming apparatus according to claim 7, wherein the detecting unit is a non-contact sensor configured to detect presence or absence of the sheet by causing light to be reflected from the sheet.

10. An image forming apparatus comprising:

a main body;

a first detection lever provided on the main body and configured to be moved by being pushed by a sheet;

an openable-and-closable portion movably supported by the main body;

a second detection lever provided on the openable-and-closable portion and configured to be movable in conjunction with a movement of the first detection lever; and a detection sensor provided on the openable-and-closable portion and configured to be activated in accordance with a movement of the second detection lever.

11. The printer according to claim 10, further comprising:

a supporting portion retained by the openable-and-closable portion so as to be movable and movably supporting the second detection lever; and a contact portion provided on the main body of the apparatus and configured to come into contact with the supporting portion in order to position the supporting portion.

12. The image forming apparatus according to claim 11, wherein the supporting portion supports the detection sensor.

13. The image forming apparatus according to claim 11, further comprising: a movable mechanism configured to cause the supporting portion to stick out in a state where the openable-and-closable portion is opened.

14. The image forming apparatus according to claim 13, wherein the movable mechanism includes a elastic member disposed between the openable-and-closable portion and the supporting portion, and wherein the contact portion moves the supporting portion against a force of the elastic member and the contact portion positions the supporting portion in a state in which the openable-and-closable portion is closed.

15. The image forming apparatus according to claim 13, further comprising: a detecting unit configured to position at a first position where the conveyed sheet is detectable in a state in which the openable-and-closable portion is closed and to move to a second position retracted from the first position by being pressed by the supporting portion in the state in which the openable-and-closable portion is opened.

16. The image forming apparatus according to claim 14, further comprising: a detecting unit configured to position at a first position where the conveyed sheet is detectable in a state in which the openable-and-closable portion is closed and to move to a second position retracted from the first position by being pressed by the supporting portion in the state in which the openable-and-closable portion is opened.

17. The image forming apparatus according to claim 10, wherein the detection sensor includes a light-emitting portion and a light-receiving portion, wherein the first detection lever includes a contact portion configured to come into contact with the sheet on which the image is formed, and an activating portion configured to move integrally with the contact portion to move the second detection lever, and wherein the second detection lever includes a subject-to-contact portion with which the activating portion comes into contact in a state in which the openable-and-closable portion is in the closed state, and a light-blocking portion configured to block light between the light-emitting portion and the light-receiving portion by moving together with the subject-to-contact portion that moves in conjunction with the activating portion.

18. The image forming apparatus according to claim 10, further comprising:

a toner image forming portion configured to form a toner image on the sheet; and a fixing portion configured to fix the toner image formed by the toner image forming portion by heat on the sheet, wherein the first detection lever is arranged such that the first detection lever comes into contact with the sheet at a position downstream of the fixing portion in a sheet conveyance direction.

* * * * *